US005427266A

United States Patent [19]

Yun

[11] Patent Number: 5,427,266

[45] Date of Patent: Jun. 27, 1995

[54] SEAL INDICATOR FOR LID AND CONTAINER

[76] Inventor: James K. Yun, 850 Vine St., 19-B, Liverpool, N.Y. 13088

[21] Appl. No.: 127,634

[22] Filed: Sep. 27, 1993

[51] Int. Cl.[6] ..... B65D 51/00

[52] U.S. Cl. ..... 220/377; 220/200; 220/355; 215/230; 206/459.1; 116/200

[58] Field of Search ..... 220/200, 355, 376, 377; 215/230; 206/459.1; 116/200

[56] References Cited

U.S. PATENT DOCUMENTS

| | | | |
|---|---|---|---|
| Re. 24,889 | 10/1960 | Tupper . | |
| 2,487,400 | 11/1949 | Tupper . | |
| 2,767,680 | 10/1956 | Lermer . | |
| 3,216,600 | 11/1965 | Dreps . | |
| 3,753,512 | 8/1973 | Curry | 220/355 X |
| 3,782,577 | 1/1974 | Levey . | |
| 3,818,858 | 6/1974 | Kramer . | |
| 4,138,029 | 2/1979 | Mahoney . | |
| 4,285,105 | 8/1981 | Kirkpatrick | 24/201 C |
| 4,412,630 | 11/1983 | Daenen | 220/353 |
| 4,456,139 | 6/1984 | Kent | 215/252 |
| 4,471,880 | 9/1984 | Taylor . | |
| 4,592,884 | 6/1986 | Thomson . | |
| 4,621,670 | 11/1986 | Yuen | 150/55 |
| 4,787,527 | 11/1988 | Monetti | 220/355 X |
| 4,907,321 | 3/1990 | Williams . | |
| 4,976,370 | 12/1990 | Cassel | 220/306 |
| 5,048,711 | 9/1991 | Weiss . | |
| 5,115,929 | 5/1992 | Buono . | |
| 5,236,101 | 8/1993 | Dugmore | 220/265 |

*Primary Examiner*—Allan N. Shoap
*Assistant Examiner*—Vanessa Caretto
*Attorney, Agent, or Firm*—Robert J. Harter

[57] ABSTRACT

A lid includes a seal indication window for viewing a corresponding seal indication surface on the rim of a container. This provides a quick visual indication of whether the container is closed properly.

28 Claims, 2 Drawing Sheets

FIG. 1
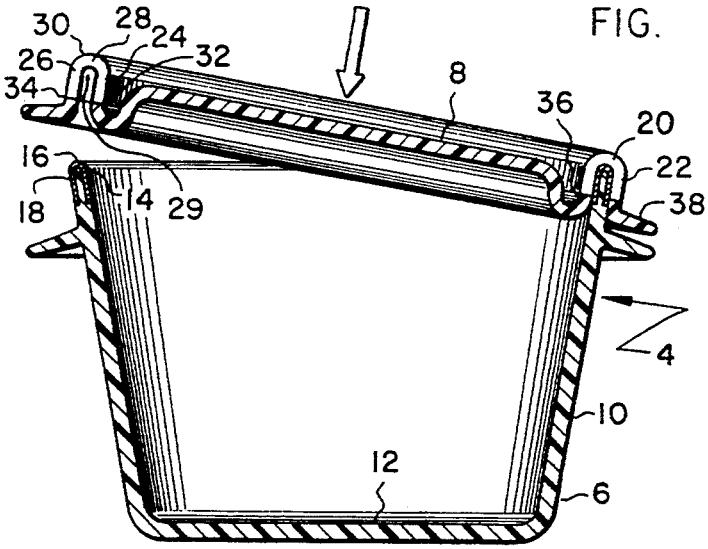
FIG. 2
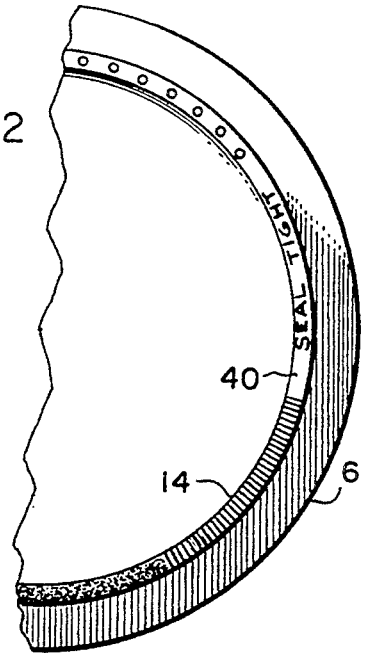
FIG. 3
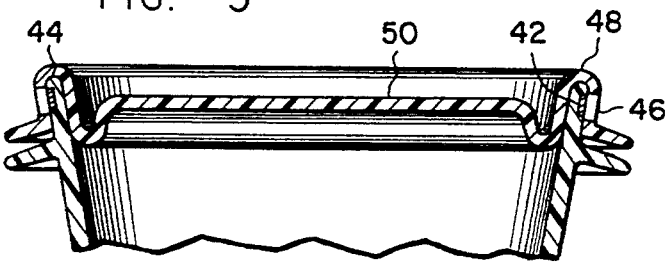
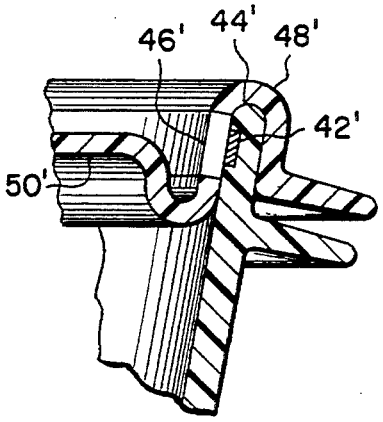
FIG. 6
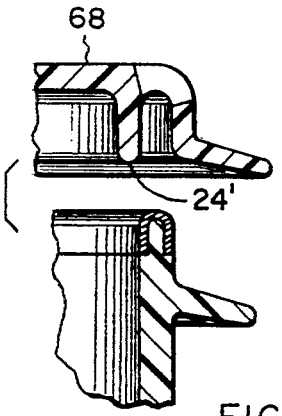
FIG. 4
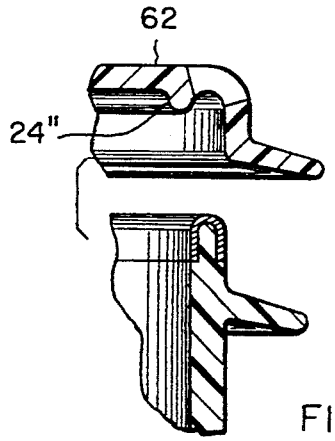
FIG. 5
FIG. 7
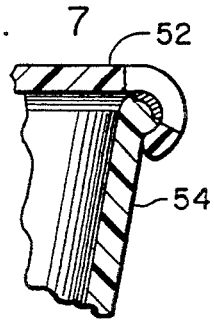

FIG. 8
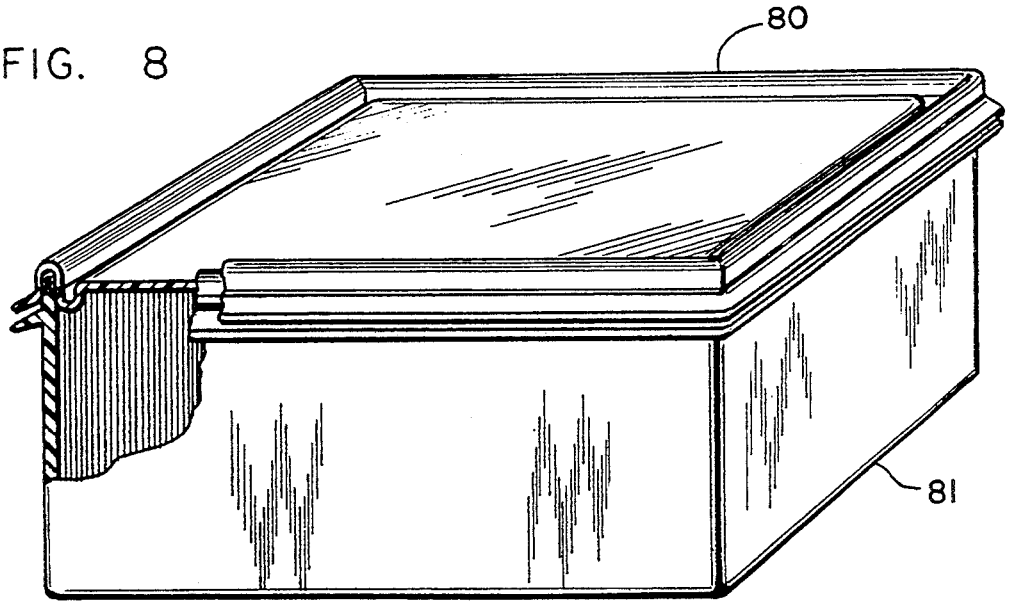
FIG. 9
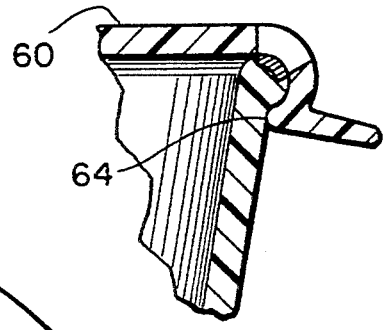
FIG. 10
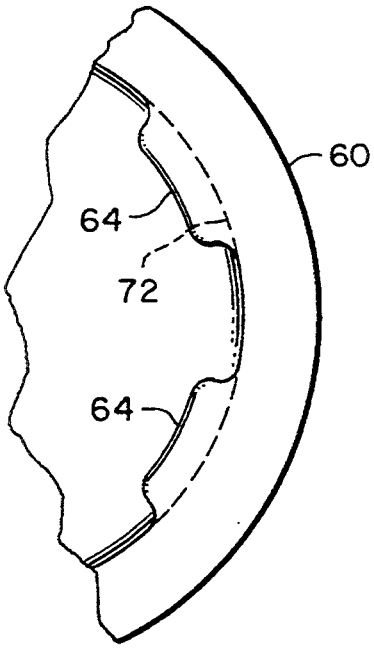
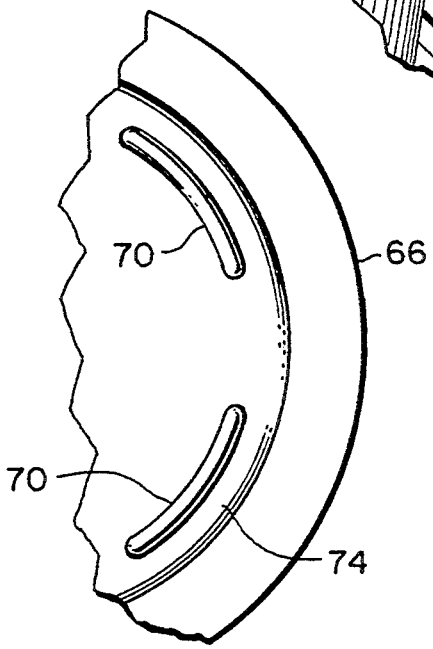
FIG. 11

SEAL INDICATOR FOR LID AND CONTAINER

BACKGROUND OF THE INVENTION

1. Field of the Invention

The subject invention generally pertains to semi-rigid plastic containers with snap-on lids and more specifically to a clear visual means of indicating the lid is properly sealed to the container.

2. Description of Related Art

Today's typical plastic food storage container includes a lid that snaps or slips onto the container simply by applying pressure. However, after the lid is supposedly on, repeated pressure is usually applied to ascertain the lid is completely on and the container is properly sealed. This is especially true for substantially rectangular containers. Moreover, should someone other than the one who first closed the container come across it, the same procedure of reapplying pressure would have to be used to tell whether the container had been properly sealed.

SUMMARY OF THE INVENTION

To overcome the problems of today's enclosures, it is an object of the invention to provide a novel container/lid combination with visual means for indicating when the lid is properly sealed against the container.

Another object of the invention is to provide a novel snap-on lid that indicates proper sealing when used on a conventional opaque container.

Another object is to provide a novel see-through container with a seal indication surface that indicates proper sealing when used with a conventional translucent lid.

Another object is to provide a novel snap-on lid and a novel see-through container that when used together provide a visual means for indicating when the lid/container combination is properly closed and sealed.

These and other objects of the invention are provided by a novel lid/container combination wherein the lid includes a window bordered by shaded areas. The window extends in a continuous loop along the peripheral edge of the lid. The container is primarily see-through and includes a narrow colored band (seal indication surface) extending in a continuous loop along the sealing rim of the container, whereby the colored band is clearly visible through the lid's window when the container is properly closed.

BRIEF DESCRIPTION OF THE DRAWINGS

FIG. 1 shows a cross-sectional view of the subject invention. The drawing shows an enclosure in the process of being closed.

FIG. 2 shows a partial top view of a container of an alternate embodiment of FIG. 1.

FIG. 3 shows another embodiment of the invention.

FIG. 4 shows a lid with a fairly long inner lip.

FIG. 5 shows a lid with a relatively short inner lip referred to as a circumferential bead.

FIG. 6 shows another embodiment of the invention.

FIG. 7 shows a lid groove extending radially into the lid as opposed to axially.

FIG. 8 is a perspective cutaway view of the invention.

FIG. 9 is a cross-sectional view of one embodiment of the invention.

FIG. 10 is a partial bottom view of the lid of FIG. 9.

FIG. 11 shows a bottom view of a lid with an intermittent groove.

DESCRIPTION OF THE PREFERRED EMBODIMENT

Enclosure 4 of FIG. 1, is a two-piece assembly comprising a container 6 and a lid 8. Container 6 includes a side wall 10 integrally joined to a bottom 12. A sealing rim 14 extends along a peripheral edge 16 of container 6. The overall shape of enclosure 4 is not a critical feature of the invention, and it can be generally round, rectangular, or polygonal. An example of a rectangular enclosure having a container 81 and a lid 80 is shown in FIG. 8. Referring back to FIG. 1, container 6 is of a one-piece construction made of translucent plastic. A seal indication surface 18, such as a colored band, is disposed along peripheral edge 16. In one embodiment of the invention, surface 18 is red and the rest of container 6 is translucent white.

Lid 8 of FIG. 1 is also made of plastic but is primarily opaque. Lid 8 includes an integral seal 20 along its peripheral edge 22. Lid seal 20 comprises an inner sealing lip 24 and a circumferentially longer outer sealing lip 26. Lips 24 and 26 are integrally joined at a groove root 28 to define a continuous groove 29 along peripheral edge 22 of lid 8. Inner sealing lip 24 can be of various shapes other than that shown in FIG. 1. For example, FIG. 4 shows another inner sealing lip 24'. The inner sealing lip can also be much shorter as shown in FIG. 5. A relatively short inner sealing lip 24" can be referred to as a circumferential bead as it is called in U.S. Pat. No. 4,471,880 which is specifically incorporated by reference herein.

Lid 8 includes at least one see-through area such as a seal indication window 30 extending in a continuous loop around lid seal 20. In one embodiment of the invention, window 30 includes an inner edge 32 and an outer edge 34 that are bordered by an inner shaded area 36 and an outer shaded area 38 respectively. In one embodiment, window 30 has a greater degree of transparency than shaded areas 36 and 38. For example, in one embodiment, window 30 is translucent and shaded areas 36 and 38 are opaque.

For a clear understanding of the invention, the terms "opaque," "transparent," "translucent," "transparency", and "see-through" are defined as follows. "Opaque" means substantially impervious to visible light. "Transparent" means having the property of transmitting visible light without appreciable scattering so that bodies lying beyond are entirely visible. "Translucent" means having the property of transmitting visible light but with appreciable diffusion. "Transparency" is the degree to which an object can pass visible light with minimal diffusion, e.g., a transparent object has a greater degree of transparency than a translucent object which in turn has a greater degree of transparency than an opaque object. "See-through" means having the property of being able to pass visible light such as is the case with transparent and translucent objects.

When lid 8 is properly seated against sealing rim 14, seal indication surface 18 is aligned with and clearly visible through window 30, as shown by the right side of FIG. 1. This indicates the right side (of FIG. 1) of enclosure 4 is properly in place while the left side (of FIG. 1) isn't.

Having shaded areas 36 and 38 adjacent to window 30 focuses one's attention to the proper viewing spot and helps avoid an improper seal indication. Also, having window 30 translucent, rather than transparent, enhances proper seal indication. This is because the image of seal indication surface 18 as viewed through a translucent window 30 quickly becomes hazy by increased diffusion as a translucent window 30 separates from seal indication surface 18. To take further advantage of this increased diffusion effect, in one embodiment of the invention, indication surface 18 is a fine pattern whose image quickly becomes out of focus with slight separation between a translucent window 30 and a patterned seal indication surface 40 of FIG. 2. The pattern of seal indication surface 40 can be a random or repeated pattern of markings.

There are many alternate embodiments of the invention. In FIG. 3, for example, seal indication surface 42 is at the outer edge of sealing rim 44 and window 46 is only on the outer sealing lip 48 of lid 50. In FIG. 6, seal indication surface 42' is at the inner edge of sealing rim 44' and window 46' is only on the inner sealing lip 48' of lid 50'. FIG. 7 illustrates another embodiment well within the scope of the invention with a cover 52 and a container 54. FIG. 9 shows a cover 60 similar to cover 52 of FIG. 7 and cover 62 of FIG. 5; however, bead 64 is intermittent rather than continuous. A partial bottom view of cover 60 showing intermittent bead 64 is shown in FIG. 10. FIG. 11 shows a partial bottom view of a cover 66 which is essentially the same as cover 62 of FIG. 5 and cover 68 of FIG. 4, except cover 66 has an intermittent bead 70 as opposed to a continuous bead 24' and 24''. An intermittent bead such as 64 and 70 define an intermittent groove 72 and 74 as opposed to a continuous groove such as groove 29.

In some embodiments of the invention, seal indication surface 18 is distinguishable from immediately adjacent areas of container 6 by way of color, such as different shades of the same basic color (e.g., dark blue/light blue) or completely different colors (e.g., black/white). In another embodiment, container 6 is made of a one-color polyethylene plastic and is substantially opaque throughout. With a one-color opaque container, proper seal indication is provided by translucent window 30 moving sealing rim 14 of container 6 in and out of focus. In various embodiments of the invention, window 30 can be transparent, translucent, colored, or uncolored. The remainder of lid 8 can be transparent, translucent, opaque, colored, or uncolored. In one embodiment, lid 8 is made of a one-color polyethylene plastic and is translucent throughout. With such a design, proper seal indication is provided by a translucent lid moving seal indication surface 18 of container 6 in and out of focus.

Acquiring various degrees of transparency can be accomplished by material selection and/or surface finish roughness, and is well known and readily accomplished by those skilled in the art. Likewise, selective coloring of plastics by way of staining and ink printing is well known and readily accomplished by those skilled in the art.

Although the invention is described with respect to a preferred embodiment, modifications thereto will be apparent to those skilled in the art.

I claim:

1. A two-piece enclosure comprising:

a container bottom;

a side wall extending continuously around and integrally joined to said container bottom to comprise a unitary container, said side wall having a continuous peripheral edge;

a sealing rim disposed continuously along said side wall to become an integral part of said continuous peripheral edge of said side wall;

a lid;

a lid seal comprising an outer sealing lip extending continuously around and integrally joined to a peripheral edge of said lid to become an integral part of said lid and forming one side of a groove along said peripheral edge of said lid, said groove being adapted to sealingly engage said sealing rim of said container; and a seal indication window disposed around said lid seal in a loop having an inner edge and an outer edge, said window being bordered by a shaded area along both said inner edge and said outer edge, said window having a greater degree of transparency than said shaded area.

2. The enclosure of claim 1, wherein said groove runs continuously along said peripheral edge of said lid.

3. The enclosure of claim 1, said lid seal further comprising an inner sealing lip circumferentially shorter than said outer sealing lip and integrally joined to said peripheral edge of said lid to become an integral part thereof.

4. The enclosure of claim 1, wherein said shaded area is substantially translucent.

5. The enclosure of claim 1, wherein said shaded area is substantially opaque.

6. The enclosure of claim 1, wherein said window is substantially transparent.

7. The enclosure of claim 1, wherein said window is substantially translucent.

8. The enclosure of claim 1, further comprising a seal indication surface disposed in a loop along said sealing rim, said seal indication surface being distinguishable from immediately adjacent areas of said unitary container by way of color.

9. The enclosure of claim 8, wherein said seal indication surface includes a pattern of markings.

10. A two-piece enclosure comprising:

a see-through container bottom;

a see-through side wall extending continuously around and integrally joined to said container bottom to comprise a see-through unitary container, said side wall having a continuous peripheral edge;

a sealing rim disposed continuously along said side wall to become an integral part of said continuous peripheral edge of said side wall;

a seal indication surface disposed in a loop along said sealing rim, said seal indication surface being distinguishable from immediately adjacent areas of said see-through unitary container by way of color;

a lid that includes a see-through area; and a lid seal comprising an outer sealing lip extending continuously around and integrally joined to a peripheral edge of said lid to become an integral part of said lid and forming one side of a groove along said peripheral edge of said lid, said groove being adapted to sealingly engage said sealing rim of said container.

11. The enclosure of claim 10, wherein said groove runs continuously along said peripheral edge of said lid.

12. The enclosure of claim 10, said lid seal further comprising an inner sealing lip circumferentially shorter than said outer sealing lip and integrally joined to said peripheral edge of said lid to become an integral part thereof.

13. The enclosure of claim 10 wherein most of said see-through unitary container is substantially translucent.

14. The enclosure of claim 10 wherein most of said see-through unitary container is substantially transparent.

15. The enclosure of claim 10 wherein said seal indication surface is substantially opaque.

16. The enclosure of claim 10 wherein said seal indication surface is substantially see-through.

17. The enclosure of claim 10 wherein said seal indication surface includes a pattern of markings.

18. The enclosure of claim 10 further comprising a seal indication window disposed around said lid seal in a loop having an inner edge and an outer edge, said window being bordered by a shaded area along both said inner edge and said outer edge, said window having a greater degree of transparency than said shaded areas.

19. The enclosure of claim 18, wherein said shaded area is substantially translucent.

20. The enclosure of claim 18, wherein said shaded area is substantially opaque.

21. The enclosure of claim 18, wherein said window is substantially transparent.

22. The enclosure of claim 18, wherein said window is substantially translucent.

23. The enclosure of claim 10, wherein said at least one see-through area is translucent.

24. A two-piece enclosure comprising:

a see-through plastic container bottom;

a see-through plastic side wall extending continuously around and integrally joined to said see-through plastic container bottom to comprise a unitary see-through plastic container, said see-through plastic side wall having a continuous peripheral edge;

a sealing rim disposed continuously along said see-through plastic side wall to become an integral part of said continuous peripheral edge of said see-through plastic side wall;

a seal indication surface disposed in a loop along said sealing rim, said seal indication surface being distinguishable from immediately adjacent areas of said unitary see-through plastic container by way of color;

a plastic lid;

a lid seal comprising an outer sealing lip extending continuously around and integrally joined to a peripheral edge of said lid to become an integral part of said lid and forming one side of a groove along said peripheral edge of said plastic lid, said groove being adapted to sealingly engage said sealing rim of said see-through plastic container; and a seal indication window disposed around said lid seal in a loop having an inner edge and an outer edge, said window being bordered by a shaded area along both said inner edge and said outer edge, said window having a greater degree of transparency than said shaded areas.

25. The enclosure of claim 24, wherein said groove runs continuously along said peripheral edge.

26. The enclosure of claim 24, wherein said seal indication surface includes a pattern of markings.

27. The enclosure of claim 24, wherein most of said see-through plastic container is substantially translucent.

28. The enclosure of claim 24, wherein most of said see-through plastic container is substantially transparent.

* * * * *